US008430008B2

(12) United States Patent
Barrett et al.

(10) Patent No.: US 8,430,008 B2
(45) Date of Patent: Apr. 30, 2013

(54) STUDIO TOOL

(76) Inventors: Tricia Anne Barrett, Corona, CA (US); Brian Hamilton Fogg, Corona, CA (US)

( * ) Notice: Subject to any disclaimer, the term of this patent is extended or adjusted under 35 U.S.C. 154(b) by 350 days.

(21) Appl. No.: 12/956,304

(22) Filed: Nov. 30, 2010

(65) Prior Publication Data

US 2011/0126684 A1 Jun. 2, 2011

Related U.S. Application Data

(60) Provisional application No. 61/265,829, filed on Dec. 2, 2009.

(51) Int. Cl.
*B26F 1/14* (2006.01)

(52) U.S. Cl.
USPC ..... 83/588; 83/613; 83/686

(58) Field of Classification Search ..... 83/582, 83/588, 613, 627, 684, 686, 697, 821, 520; 156/510, 513, 526
See application file for complete search history.

(56) References Cited

U.S. PATENT DOCUMENTS

| | | | | |
|---|---|---|---|---|
| 2,123,377 | A * | 7/1938 | Papp et al. | 156/386 |
| 5,601,006 | A * | 2/1997 | Quinn et al. | 83/588 |
| 6,752,058 | B2 * | 6/2004 | Oh | 83/588 |
| 2004/0129124 | A1 * | 7/2004 | Chan | 83/588 |

* cited by examiner

*Primary Examiner* — Stephen Choi
(74) *Attorney, Agent, or Firm* — Rankin, Hill & Clark LLP

(57) ABSTRACT

A studio tool for working stock includes an upper housing, a lower housing, a viewfinder, a viewfinder cover, an alignment tool, and a pressure column. The upper housing and the lower housing are slidably connected so as to at least partially contain the alignment tool and pressure column. A main spring and lower springs may be used to bias the column blade.

20 Claims, 14 Drawing Sheets

STUDIO TOOL

BACKGROUND

Exemplary embodiments herein relate to a studio tool, and more particularly to a studio tool used for creating shapes and buttons with unique patterns for use in the craft, tool, jewelry making, and art fields.

Scrapbooking is a method for preserving personal and family history in the form of a scrapbook. Memorabilia that is placed in the scrapbook may include photographs, printed media, and artwork. Scrapbook albums are often decorated and frequently contain extensive journaling. Frequently, the scrapbook album is adorned with shapes or buttons that are formed of acrylic material with a custom backing or stock that complements the photograph or the page in the scrapbook upon which the photograph is mounted. Furthermore, the customized buttons may be used by the scrapbook or when making customized clothing.

Previously, if an individual wanted to create a custom shape or button there were a limited number of available options and the process was quite cumbersome. For example, the individual would have to purchase a clear shape or button and a clear adhesive that was capable of attaching their custom stock to the shape or button. Then, they would have to engage in the time consuming and tedious process of applying the adhesive to the shape or button and affixing the shape or button to the stock. Then, the individual would have to trim the stock so that it would be the same size as the shape or button. Further still, the individual would need to pierce holes in the stock that would be aligned with the holes in the button. As can be imagined, this made it very difficult to create a custom button or shape that had a professional appearance. Because of the involved time commitment associated with creating such a customized button or shape, many times the individual would avoid creating the button or shape and miss out on creating the memorable keepsake.

BRIEF DESCRIPTION

According to one aspect, a studio tool for working stock includes an upper housing with a sidewall that defines a generally circular-cross-section, and a lower housing that slidably engages the upper housing. The lower housing includes a side and a bottom wall. The side extends from the bottom wall toward the upper housing. A column blade boss extends from the bottom wall in a direction generally parallel to the side. The studio tool also includes a viewfinder that is at least partially fixed to the upper housing. The viewfinder includes an upper guide and a lower guide that cooperate to define a feed slot. The viewfinder defines an aperture that extends through the upper and lower guides. The studio tool also includes a viewfinder cover that at least partially circumferentially surrounds the upper guide of the viewfinder. The viewfinder cover includes tab receipt areas. The studio tool further includes a lid press that is hingedly attached to the viewfinder, and an alignment tool that includes a spacer with outwardly and radially extending tabs. The tabs are received by the tab receipt areas of the viewfinder cover. The spacer includes a stock face and a lid press face. The stock face faces toward the stock and includes alignment barrels that extend toward the viewfinder. The lid press face faces toward the lid press. The studio tool also includes a pressure column that is coaxially received on the column blade boss. The pressure column includes alignment pins that extend toward the lid press. The alignment pins are selectively received by the alignment barrels of the alignment tool. The studio tool also includes a column blade that is received within the upper housing and coaxially surrounds the pressure column. The column blade selectively extends through the aperture to be coplanar with the upper guide.

According to another aspect, a studio tool for working stock includes an upper housing with a sidewall that extends between a feed ring and a retention ring. The feed ring extends radially outward from the sidewall and the retention ring extends radially inward from the sidewall. The feed ring defines a top opening and the retention ring defines a bottom opening. The studio tool also includes a lower housing that is at least partially received within the upper housing. The lower housing includes a side that extends between an annular lift and a bottom wall. The bottom wall includes a column blade boss that extends toward the opening of the upper housing. The annular lip has a first outer diameter and the retention ring has a first inner diameter. The first outer diameter is greater than the first inner diameter. The studio tool also includes a viewfinder with a lower guide that is circumferentially surrounded by the feed ring of the upper housing and an upper guide located such that the lower guide is disposed between the upper guide of the viewfinder and the retention ring of the upper housing. The upper and lower guides cooperate to define a feed slot. The viewfinder defines an aperture that extends through the upper and lower guides in a direction generally parallel to the side of the lower housing. The upper and lower guides each include a feed ramp that circumferentially surrounds the aperture such that the feed ramps guide the stock between the upper and lower guides. The studio tool also includes a viewfinder cover that is at least partially circumferentially surrounded by the upper guide of the viewfinder and the viewfinder cover also includes tab receipt areas. The studio tool further includes a lid press that is hingedly attached to the viewfinder, and an alignment tool with a spacer with outwardly and radially extending tabs that are received by the tab receipt areas of the viewfinder cover. The spacer includes a stock face that faces toward the stock and a lid press face that presses toward the lid press. The studio tool also includes a column blade that is coaxially received on the column blade boss and is selectively movable between a first position and a second position. The first position is defined by the column blade being coplanar with the lower guide such that the stock may be inserted into the feed slot and pass through the aperture. The second position is defined by the column blade being coplanar with the upper guide such that the stock is prevented from being inserted into the feed slot to pass through the aperture. The column blade is closer to the lid press in the second position than in the first position.

DETAILED DESCRIPTION

Figure 1:
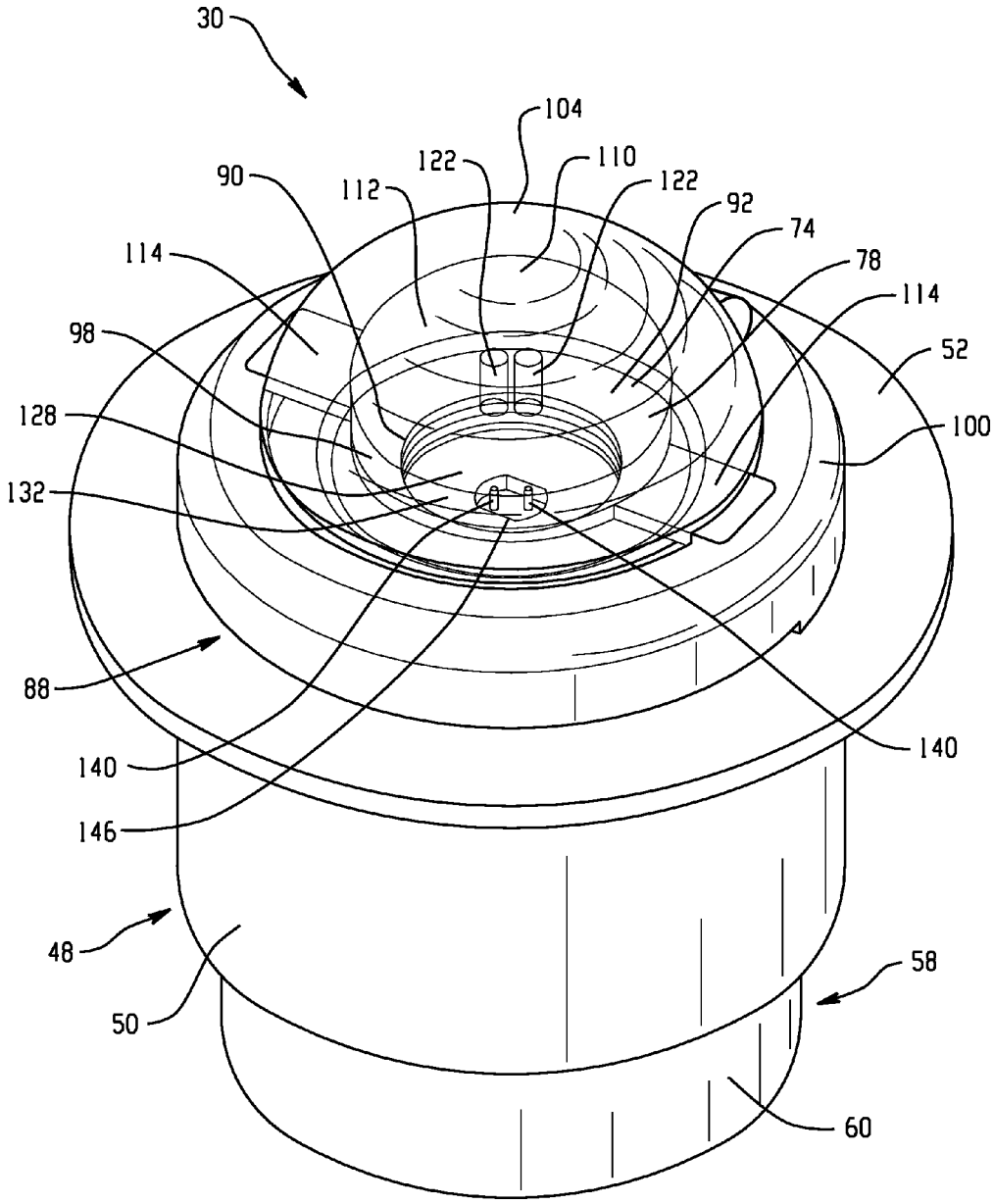
FIG. 1 is perspective view of the studio tool with the lid press closed.
Figure 3:
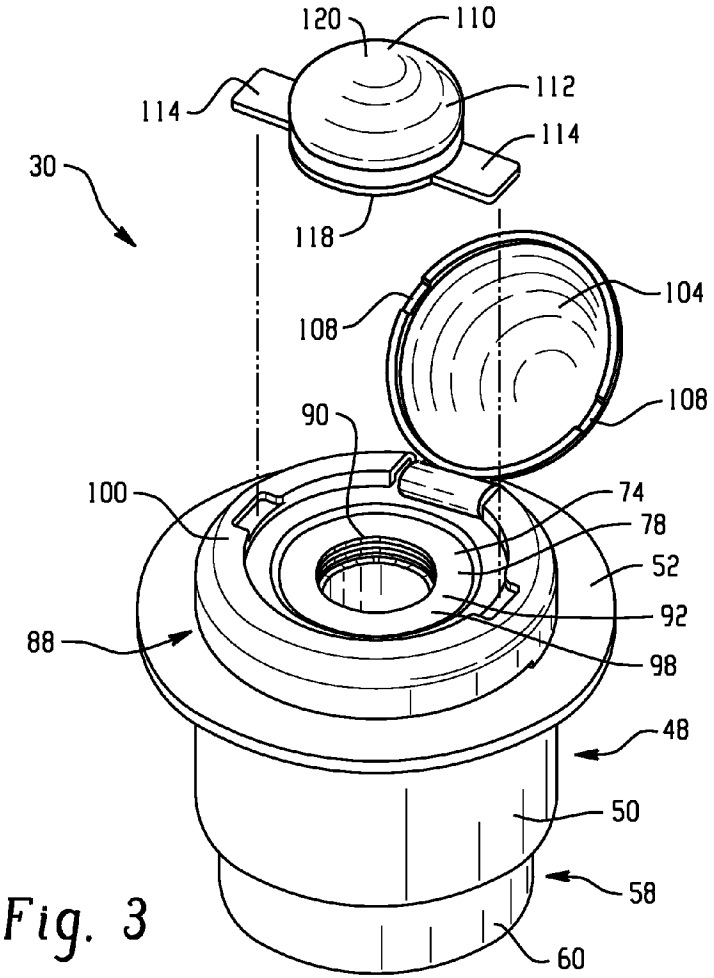
FIG. 3 is a perspective view of the studio tool with the lid press open.
Figure 2:
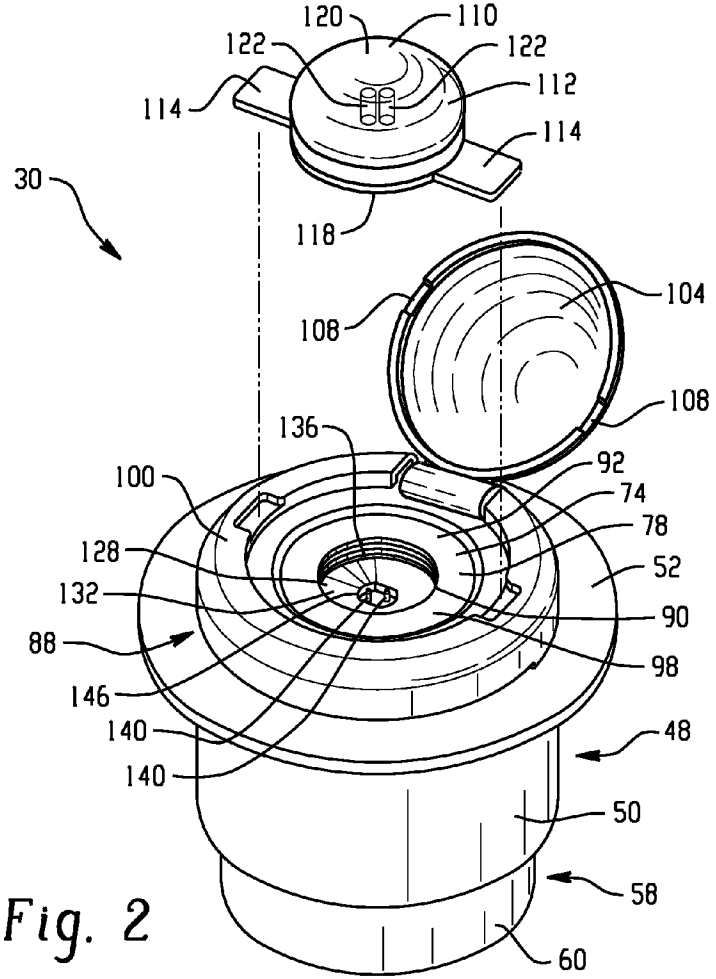
FIG. 2 is a perspective view of the studio tool with alignment pins with the lid press open.

Referring now to the drawings, wherein they are for purposes of illustrating one or more exemplary embodiments and not for purposes of limiting same, FIGS. 1-3 illustrate a studio tool 30 of the present application.

It should, of course, be understood that the descriptions and drawings herein are merely illustrative and that various modifications and changes can be made in the structures disclosed without departing from the present disclosure. It will also be appreciated that various identified components of the studio tool disclosed herein are merely terms of art and may vary from one studio tool manufacturer to another and should not be deemed to limit the present disclosure. All references to direction and position, unless otherwise indicated, refer to the orientation of the studio tool illustrated in the drawings and should not be construed as limiting the claims appended hereto. Like numerals refer to like parts through the several views.

Initially, it is noted that the present disclosure uses the term stock to reflect any number of materials. For example, the stock 32 could include various types of paper, foil, print media, and fabric. The thickness of the stock 32 is only controlled by the size of the feed slot 88 as will be discussed below.

Figure 4:
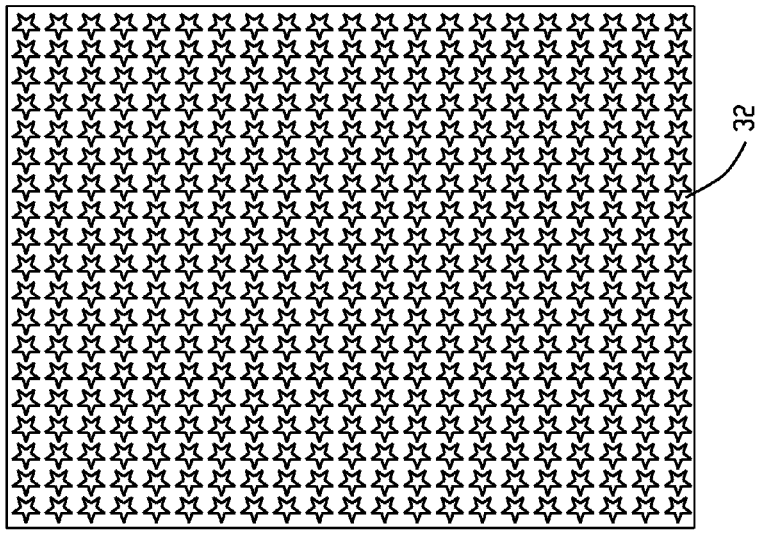
FIG. 4 is a sectional view of the studio tool, a button, and a piece of stock.
Figure 4:
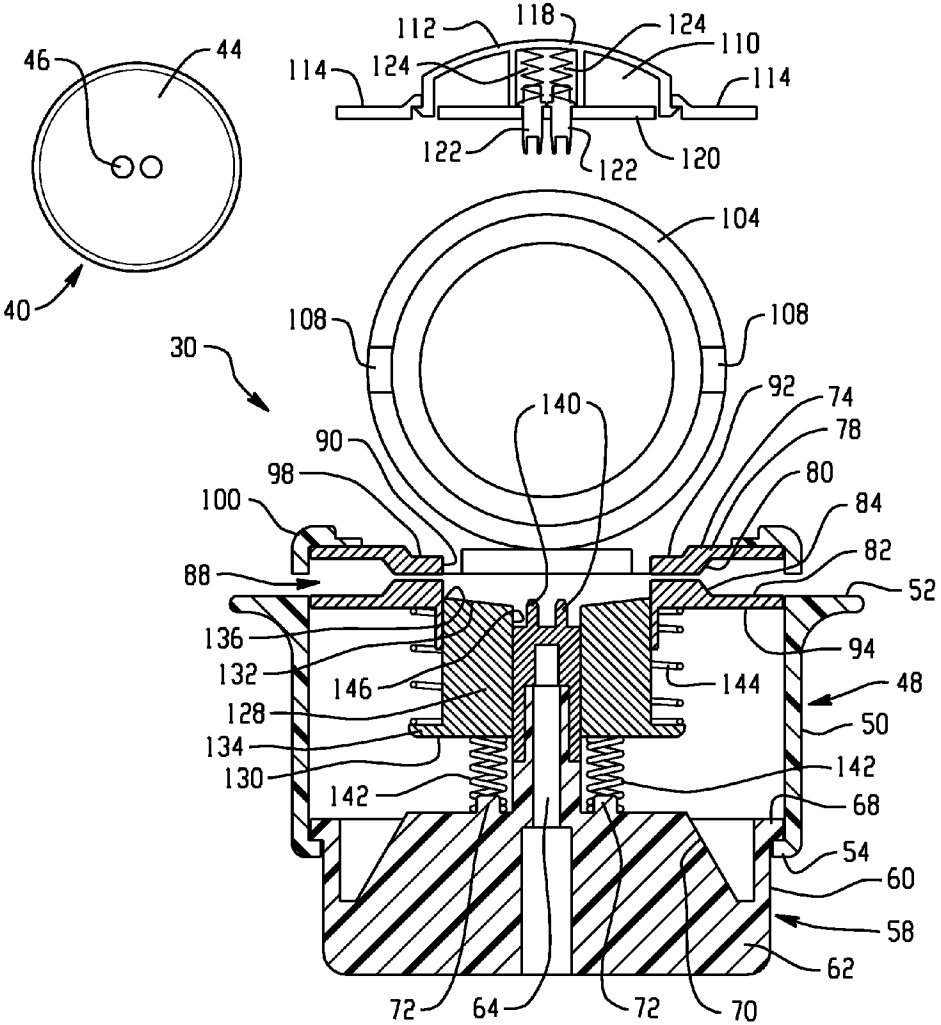

With reference to FIGS. 1-3, the studio tool 30 can include an alignment tool 110 that can be selectively placed within the studio tool 30. The studio tool 30 can also include a lid press 104 hingedly attached to a viewfinder cover 110, an upper housing 48, and a lower housing 58. The studio tool 30 may also include a viewfinder 74 that slidably receives a pressure column 138 and a column blade 128. With reference to FIG. 4, the studio tool 30 may also include a main spring 144 and lower springs 142.

Figure 11:
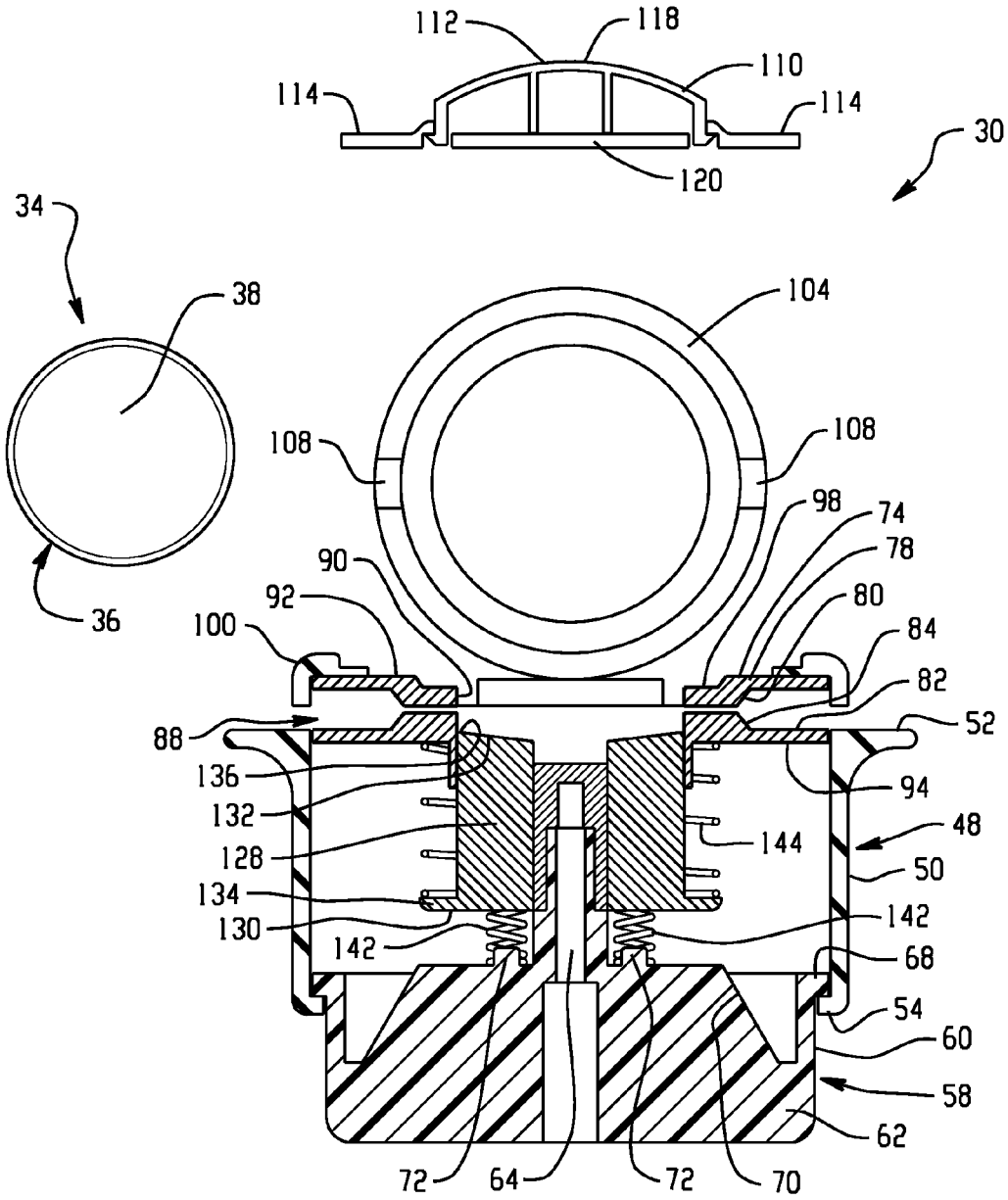
FIG. 11 is a sectional view of the studio tool and a shape.

FIG. 4 illustrates a button 40 that can include holes 46, an adhesive side 42, and a non-adhesive side 44. For reference, FIG. 11 illustrates a shape 34 that also has an adhesive side 36 and a non-adhesive side 38. Although the shape 34 and the button 40 are illustrated as having a circular shape, it is understood that other shapes are possible and contemplated. Further, the shape 34 and the button 40 may be transparent or semi-transparent in color. Further still, the shape 34 and button 40 may be made of a variety of materials. For example, the shape 34 and button 40 may be made of various polymeric compounds or glass.

With reference to FIGS. 1-9 and 11-13, the viewfinder cover 100 can have a generally circular shape from a plan view and an L-shape in vertical cross-section. The viewfinder cover 100 may include a roof portion 101 and a fascia portion 106. The roof portion 101 at least partially circumferentially surrounds a spacer face 92 of the viewfinder 74 as will also be discussed hereinbelow. By surrounding the spacer face 92, debris is prevented from entering the studio tool 30.

The roof portion 101 can include tab receipt areas 102 to receive the tabs 114 of the alignment tool 110 as will be discussed hereinafter. The fascia portion 106 can vertically extend from the roof portion 101 toward the upper housing 48 so as to completely cover an upper guide 78 of the viewfinder and minimizes a vertical space between the viewfinder cover 100 and the upper housing 48, thereby preventing access to pinch points. The viewfinder cover 100 may be constructed of any number of materials. For example, the viewfinder cover 100 may be made of polymeric compounds, glass, wood, and/or metal.

With reference once again to FIGS. 1-3, the upper housing 48 can have a circular cross-section. With reference to FIGS. 4 and 11, the upper housing 48 can include a sidewall 50 that extends between a feed ring 52 and a retention ring 54. The feed ring 52 may extend radially outward from the sidewall 50 and the retention ring 54 can extend radially inward from the sidewall 50. The feed ring 52 can cooperate with the fascia portion 106 to guide the stock 32 into the studio tool. The feed ring 52 defines a top opening and the retention ring 54 defines a bottom opening. Further, the retention ring 54 has a first inner diameter. The upper housing 48 may be of the same or different materials than the viewfinder cover 100.

The lower housing 58 may also be circular in cross-section. By having a similar shape as the upper housing 48, the lower housing can more easily slidably engage the upper housing 38. At least a portion of the lower housing 58 can be partially received in the upper housing 48. The upper housing 48 and lower housing 58 cooperate to contain the components of the studio tool 30 to reduce the exposure to various pinch points.

The lower housing 58 may include a bottom wall 62 with side 60. The side 60 can extend from the bottom wall 62 toward the upper housing 48. Further, a column blade boss 64 extends from the bottom wall 62 in a generally parallel direction with relationship to the side 60. The lower housing 58 also includes an annular lip 68 that defines a first outer diameter. The first outer diameter is greater than the first inner diameter of the retention ring 54. The bottom wall 62 can also include support flanges 70 that radially extend outward from the column blade boss 64 toward the side 60. The support flanges 70 can provide additional strength and stability to the column blade boss 64. Further, the shape of the support flanges 70 ensures that a minimum amount of additional material is needed to create the support flanges 70, thereby reducing manufacturing costs and overall tool weight.

Spring mounting pins 72 may extend from the support flanges 70. The spring mounting pins 72 may have a circular cross-section and extend toward the viewfinder 74. The circular cross-sectional shape of the mounting pins 70 ensures that the lower springs 142 are in secure contact with the lower housing 58. The spring mounting pins 72 can be disposed radially between the column blade boss 64 and the support flanges 70. The lower housing 58 may be constructed of the same or a different material as the upper housing 48.

With reference to FIGS. 4-9 and 11-13, the viewfinder 74 can include an upper guide 78 with a feed ramp 80 and a lower guide 82 with a feed ramp 84. The upper guide 78 and the lower guide 82 cooperate to define the feed slot 88. The feed ramp 80 and the feed ramp 84 are shaped so as to vertically center the stock 32. The viewfinder 74 also includes an aperture 90 that extends through the upper guide 78 and the lower guide 82. The aperture 90 extends in a direction generally parallel to the side 60 of the lower housing 58. The alignment between the aperture 90 and the side 60 ensures that a minimum amount of force is needed to operate the studio tool 30.

The viewfinder 74 further includes a spacer face 92 and a main spring face 94. The spacer face 92 faces toward the spacer 112 of the alignment tool 110 as will be discussed hereinafter. The spacer face 92 may also define an annular depression 98 that surrounds the aperture 90. The annular depression 98 can help to properly orient the shape 34 or button 40 when installed into the studio tool 30. The main spring face 94 can contact the main spring 144 as will also be discussed hereinafter. The aperture 90 may be any number of shapes including, for example, heart-shaped, flower-shaped, and circular. Other shapes are possible and contemplated. The viewfinder 74 is at least partially fixed to the upper housing 48. The viewfinder 74 may be constructed of any number of materials that would provide sufficient rigidity to allow the stock 32 to be appropriately pressed. For example, the viewfinder 74 could be made of metal. From a plan view, the viewfinder 74 may be circular in shape. This shape may be complementary to the upper housing 48.

With reference to FIGS. 1-9 and 11-13, the lid press 104 is shown. In FIG. 1, the lid press 104 is shown in the closed position and in FIGS. 2-3, the lid press 104 is shown in the open position. The lid press 104 may be transparent or semi-transparent so that the pressure column 138 and the viewfinder 74 may be viewed when the lid press 104 is closed. The lid press 104 can include tab receipt areas 108. The tab receipt areas 108 cooperate with the tab receipt areas 102 of the viewfinder 74 to surround the tabs 114 of the alignment tool 110 as will be discussed hereinafter. The lid press 104 can have a semi-spherical shape and can be made of any number of materials including various polymeric compounds or glass. The lid press 104 may be used as the area upon which a user would press on the studio tool 30 to actuate the tool 30. The lid press 104 can be hingedly attached to the viewfinder 74.

With continued reference to FIGS. 1-9 and 11-13, the alignment tool 110 includes a spacer 112 that is disposed between tabs 114. The tabs 114 extend radially outward from the spacer 112. The tabs 114 are received by the tab receipt areas 102 of the viewfinder cover 100 and the tab receipt areas 108 of the lid press 104. By surrounding the tabs 114, misalignment of the shape 34 or button 40 with the stock 32 is minimized.

The spacer 112 includes the stock face 118 that faces toward the stock 32 and the lid press face 120 that faces toward the lid press 104. With reference to FIGS. 1, 2, and 4-9, alignment barrels 122 may optionally extend from the stock face 118 of the spacer 112 toward the viewfinder 100. The alignment barrels 122 can be biased away from the stock face 118 with the alignment springs 124. The alignment springs 124 prevent any damage from occurring to the studio tool 30 if an excess amount of force is supplied to the lid press 104. The alignment tool 110 may also be transparent or semi-transparent to allow viewing of the viewfinder 74. The spacer 112 may have a semi-spherical type shape that is complementary with the lid press 104. Further, the alignment barrels 122 may be received within the holes 46 of the button 40. Further still, the alignment barrels 122 may receive the pins 140 as will be discussed below. The alignment tool 110 may be made of any number of materials, including for example, metal, glass, or polymeric compounds.

With reference once again to FIGS. 1-9 and 11-13, the column blade 128 is located within the upper housing 48. Further, the column blade 128 can be coaxially received on the column blade boss 64. The column blade 128 is movable between a first and a second position. In the first position, the column blade 128 is coplanar with the lower guide 82 of the viewfinder 74. In the second position, the column blade 128 is coplanar with the upper guide 78 of the viewfinder 74. The column blade 128 includes a spring ledge 132 and a cutting edge 136 that are disposed at opposite ends of the column blade 128.

A diameter of the column blade 128 near the cutting edge 136 is less than the aperture 90 of the viewfinder 74. However, the spring ledge 134 extends radially outward and has a diameter greater than the diameter of the aperture 90. The spring ledge 134 supports the main spring 144 to bias the column blade 128 away from the viewfinder 74. The column blade 128 also includes a lower face 130 that faces toward the bottom wall 62 and an upper face 132 that faces toward the lid press 104. The column blade 128 can further define a pressure column bore 146 to allow for the coaxial receipt of a pressure column 138 as will be discussed hereinafter.

Figure 17:
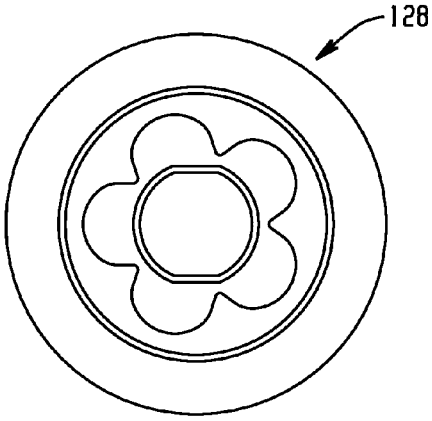
FIG. 17 is a plan view of a five-lobed flower-shaped column blade.
Figure 18:
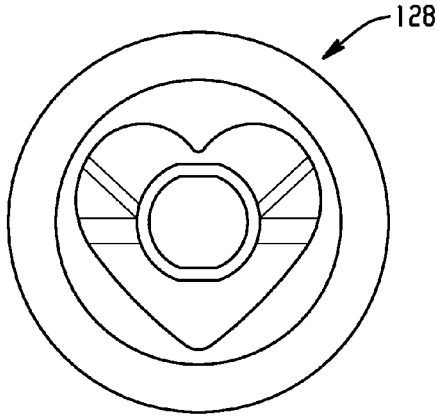
FIG. 18 is a plan view of an alternative heart-shaped column blade.
Figure 19:
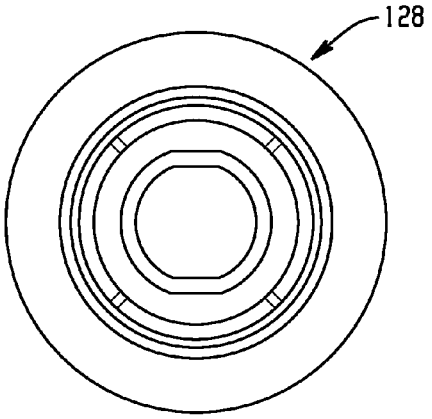
FIG. 19 is a plan view of a round-shaped column blade of smaller size.
Figure 20:
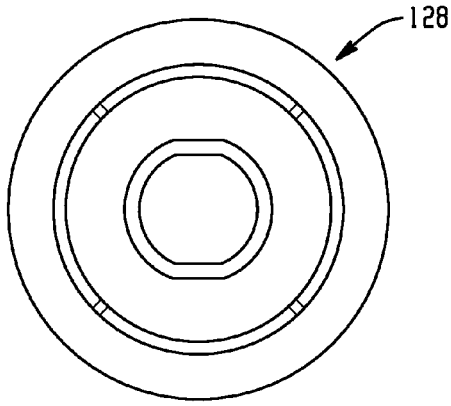
FIG. 20 is a plan view of a round-shaped column blade of larger size.
Figure 21:
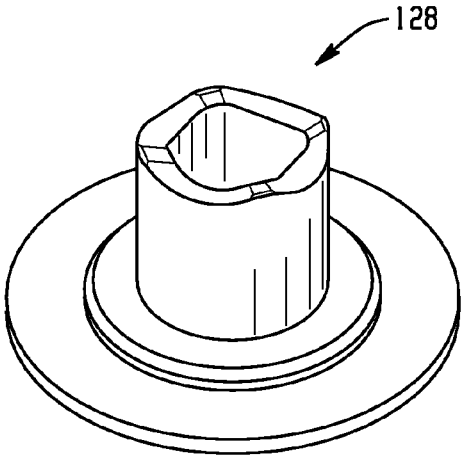
FIG. 21 is a perspective view of an alternative round-shaped column blade.
Figure 22:
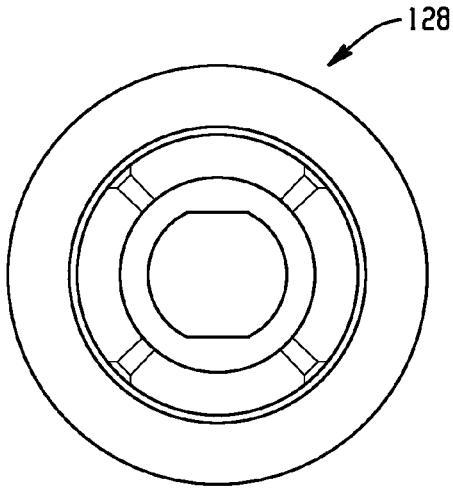
FIG. 22 is a plan view of FIG. 21.
Figure 23:
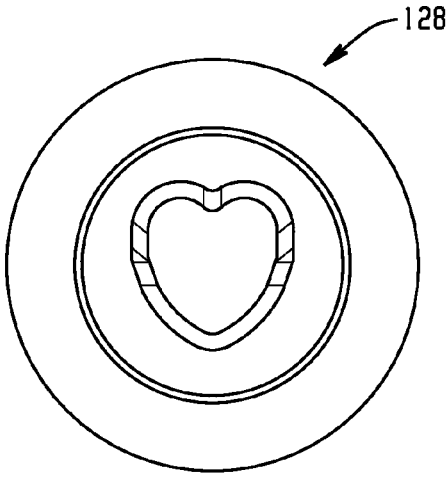
FIG. 23 is a plan view of an alternative heart-shaped column blade.

The column blade 128 can have any number of shapes. As shown in FIGS. 15, 16, 18, and 23, the column blade 128 can be heart-shaped. Alternatively, the column blade 128 can have a five-lobed flower shape as shown in FIG. 17. Further still, the column blade 128 can have a circular shape, as shown in FIGS. 19-22. The column blade can be made of any material that provides sufficient strength to allow for cutting of the stock 32.

With reference once again to FIGS. 1-9 and 11-13, the pressure column 138 can be coaxially received within the pressure column bore 146 of the column blade 128 to slide independently of one another. The pressure column 138 can be further coaxially received on the column blade boss 64 of the lower housing 58. As shown in FIGS. 1, 2, and 4-9, the pressure column 138 may optionally include the alignment pins 140. The alignment pins 140 extend toward the lid press 104 and can be selectively received by the alignment barrels 122 of the alignment tool 110. The pressure column 138 is coaxially surrounded by the column blade 128.

Lower springs 142 that are mounted to the spring-mounting pins 72 of the lower housing 58 bias the column blade 128 away from the bottom wall 62 of the lower housing 58. A main spring 144 coaxially surrounds a portion of the column blade 128. Further, the main spring 144 extends between the spring ledge 134 of the column blade 128 and the viewfinder 74. The lower springs 142 and the main spring 144 are compression springs that are commercially available.

Figure 5:
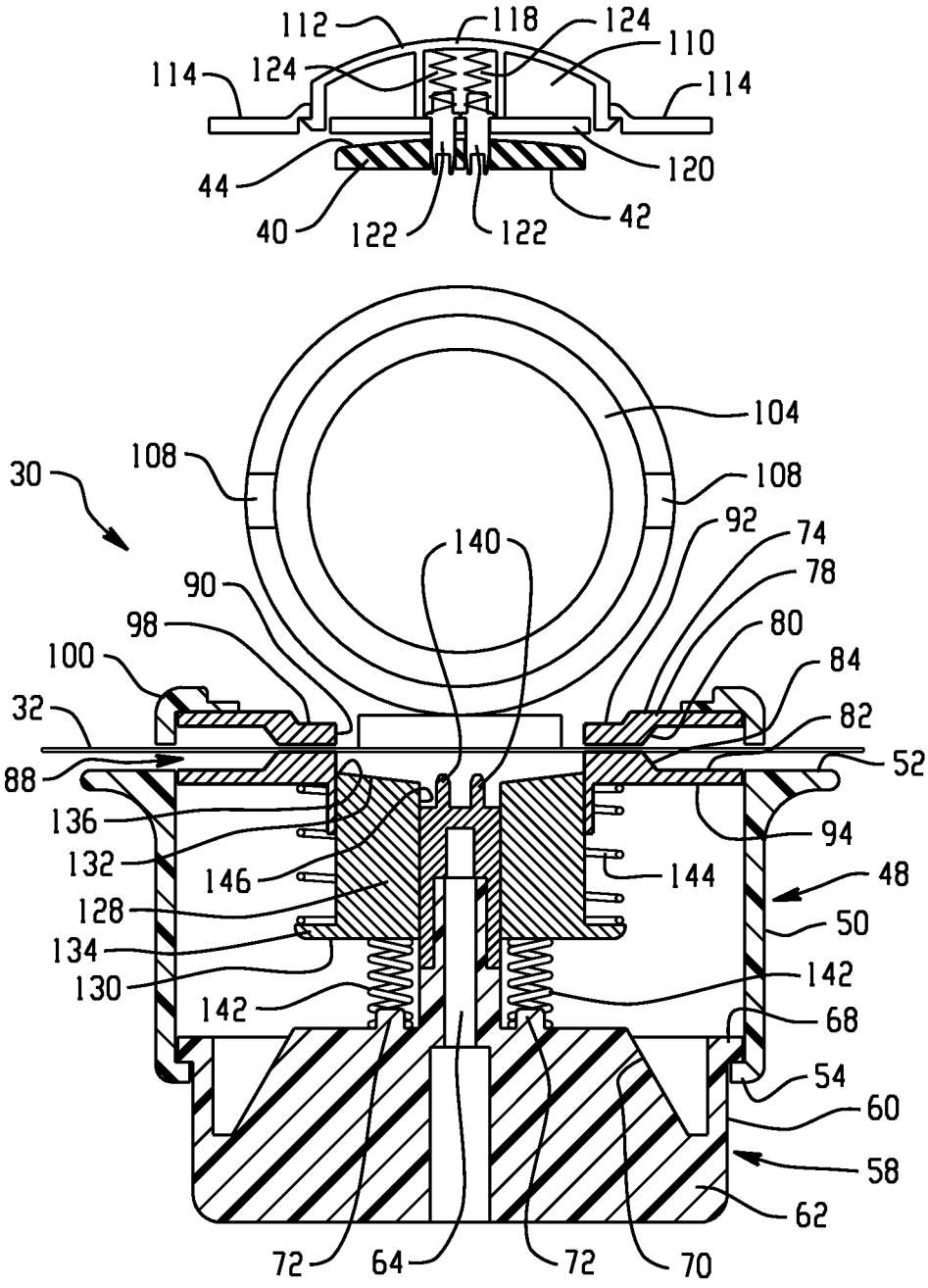
FIG. 5 is a sectional view of the studio tool with the stock inserted in the tool.
Figure 6:
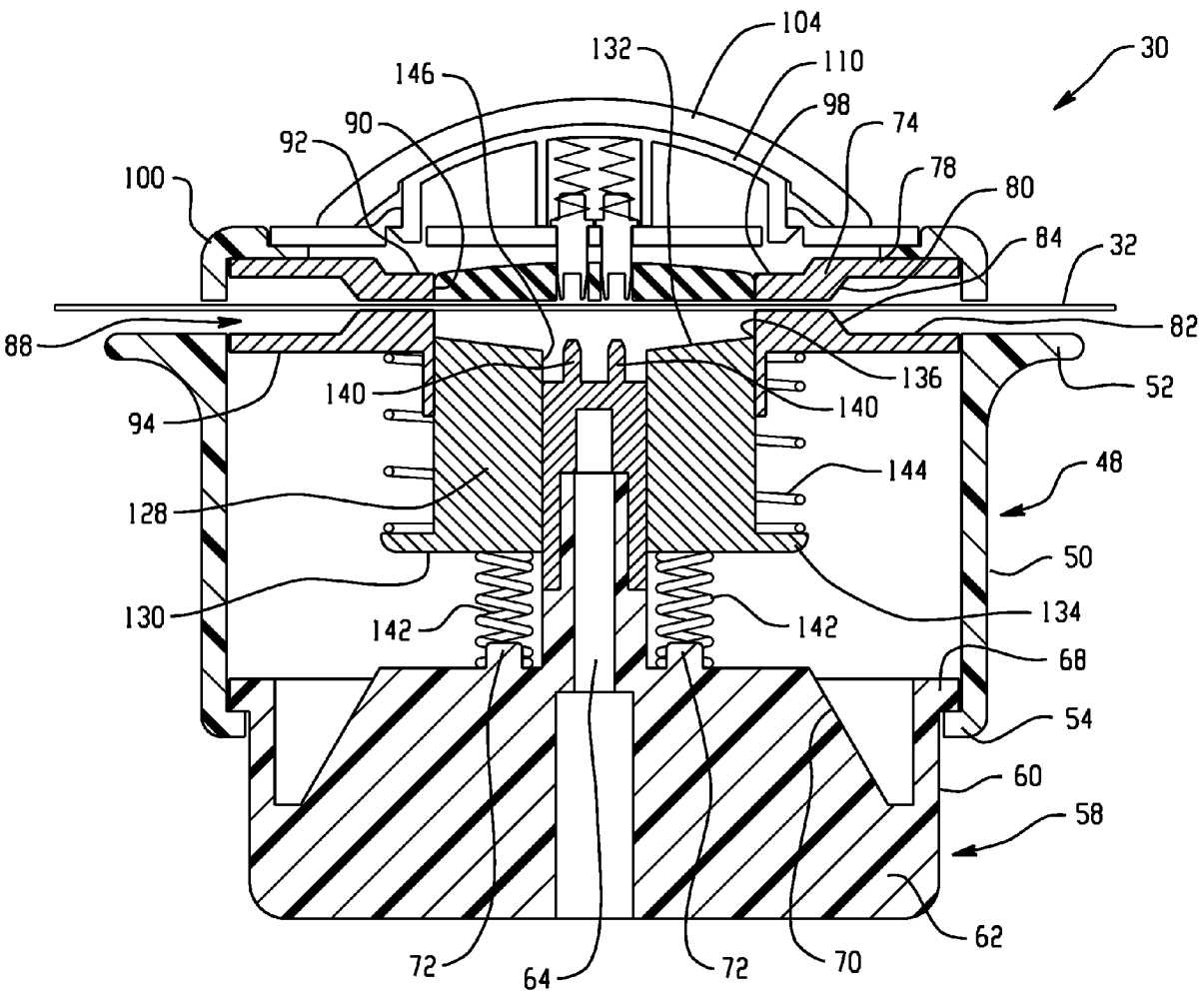
FIG. 6 is a sectional view of the studio tool with the lid press closed and the button and stock inside of the studio tool.
Figure 7:
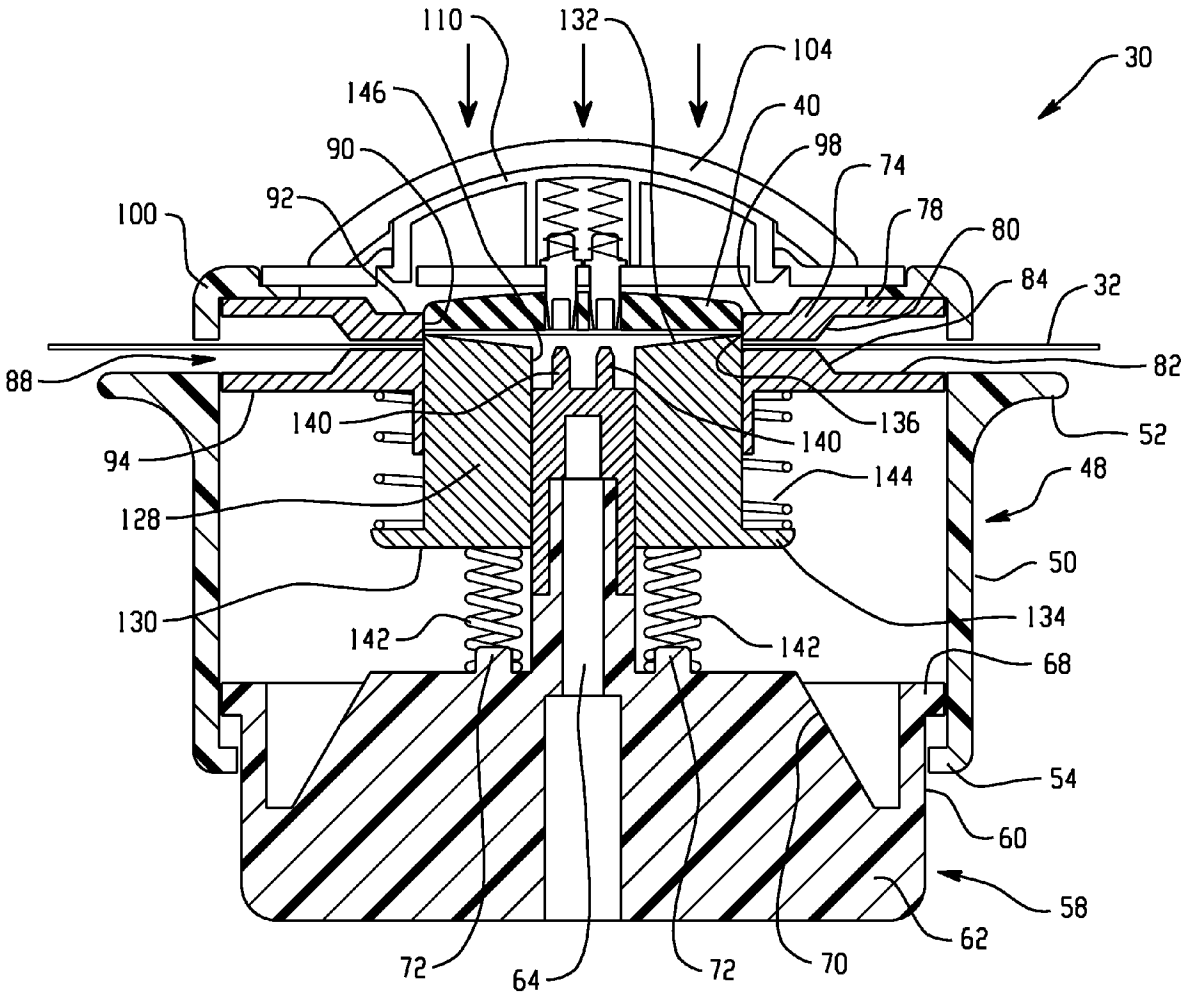
FIG. 7 is a sectional view of the studio tool cutting the stock.
Figure 8:
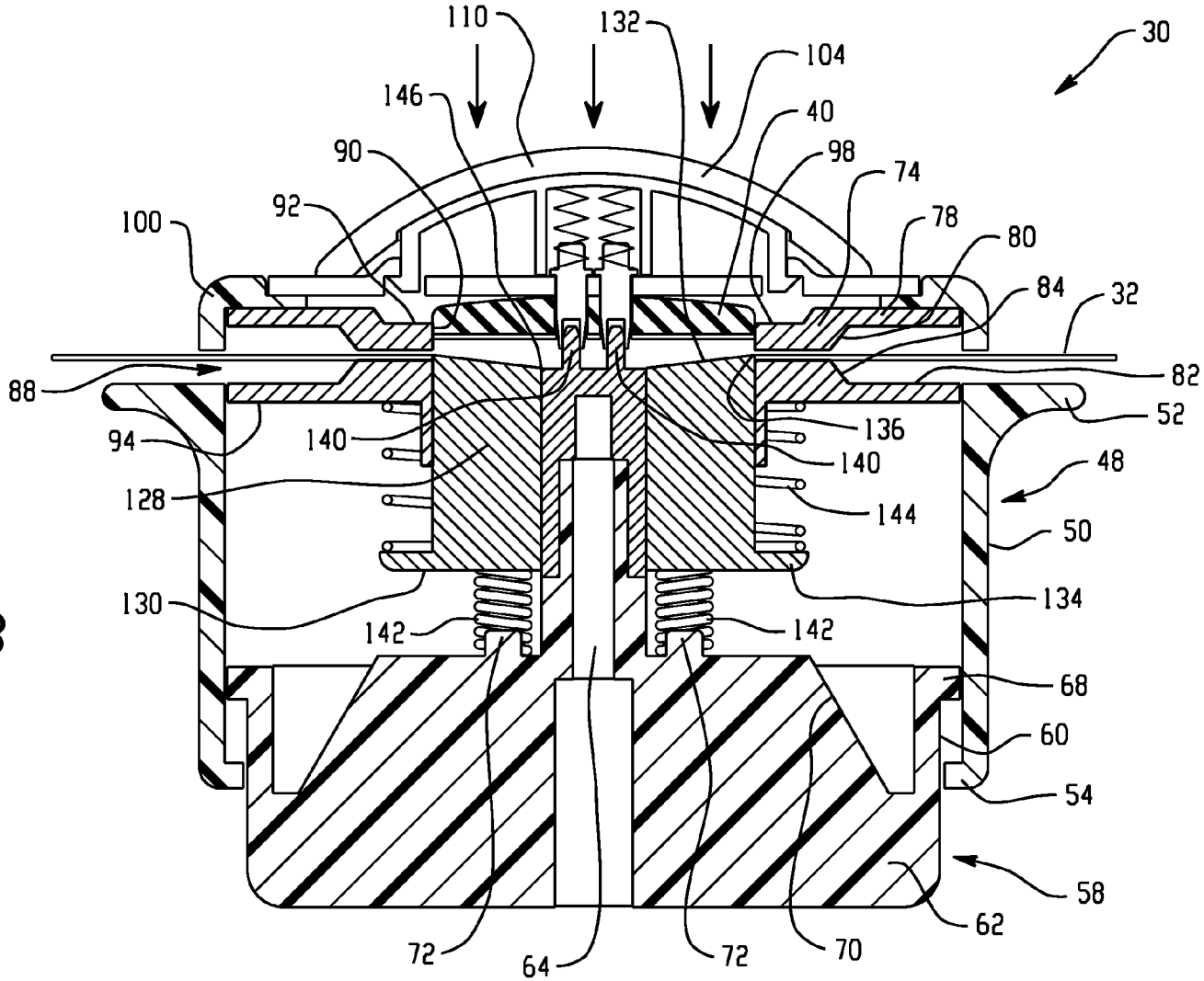
FIG. 8 is a sectional view of the studio tool affixing the stock to the button.

Operation of the studio tool 30 will now be discussed. With reference to FIG. 5, the stock 130 is inserted into the feed slot 88 and the button 40 is connected with the alignment tool 110. Specifically the alignment barrels 122 are inserted at least partially through the holes 46 of the button 40. Further, the button 40 is oriented with the alignment tool 110 such that the non-adhesive side 44 faces toward the alignment tool 110. As shown in FIG. 6, the alignment tool 110 and the button 40 are inserted into the studio tool 30 and the lid press 104 is hinged shut. Then, as is shown in FIG. 7, a force is exerted on the lid press 104 in a direction toward the bottom wall 62. As the bottom wall 62 of the lower housing 58 is supported, the upper housing 48, which is at least partially attached to the viewfinder 74, travels in a direction toward the bottom wall 62. This action causes the main spring 144 and the lower springs 142 to compress. Thus, the stock 32 is cut by the cutting edge 136 of the column blade 128. Accordingly, a shape that is similar to the column blade 128 is created from the stock 32.

Figure 9:
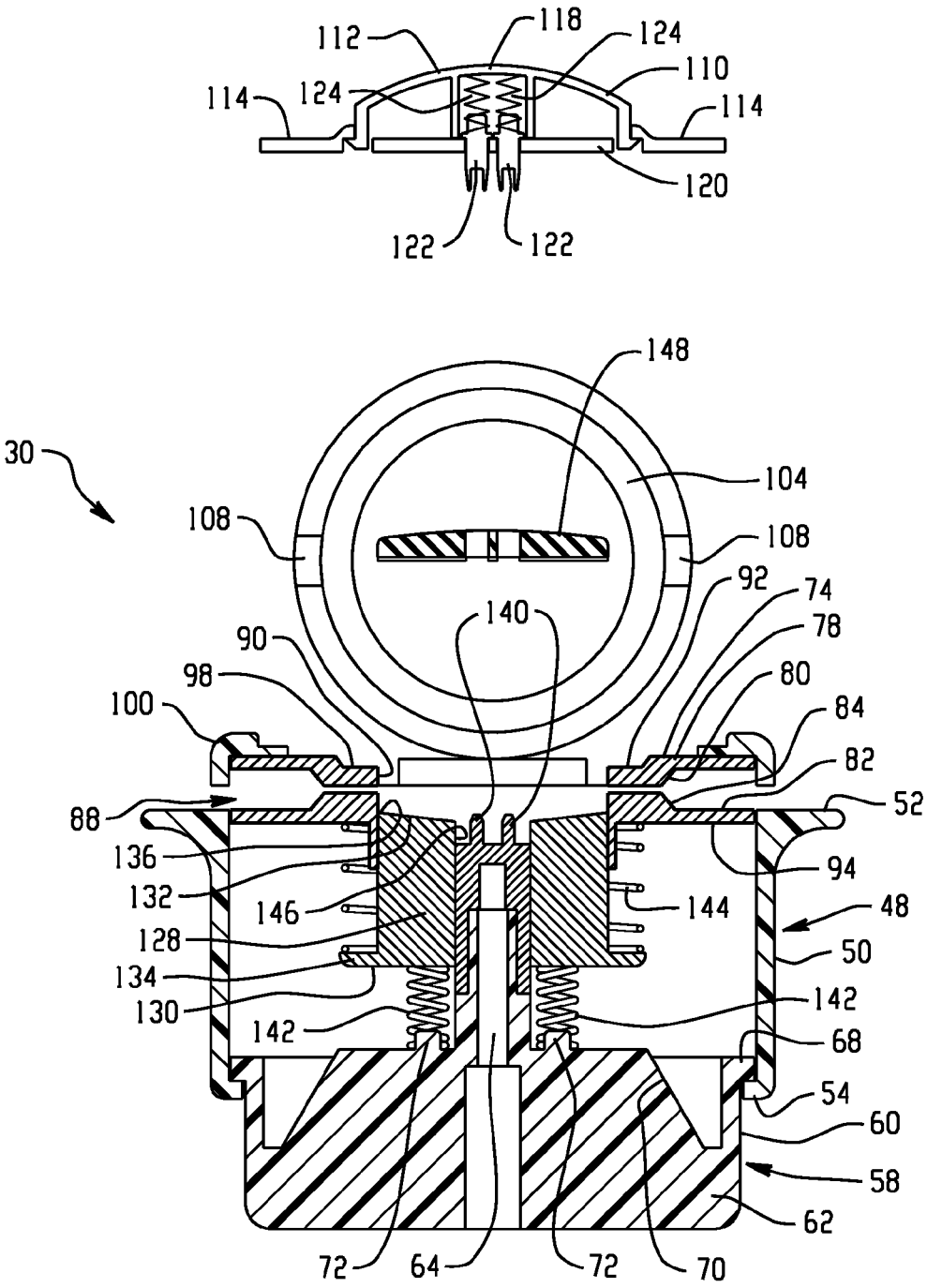
FIG. 9 is a sectional view of the studio tool and a customized button.
Figure 10:
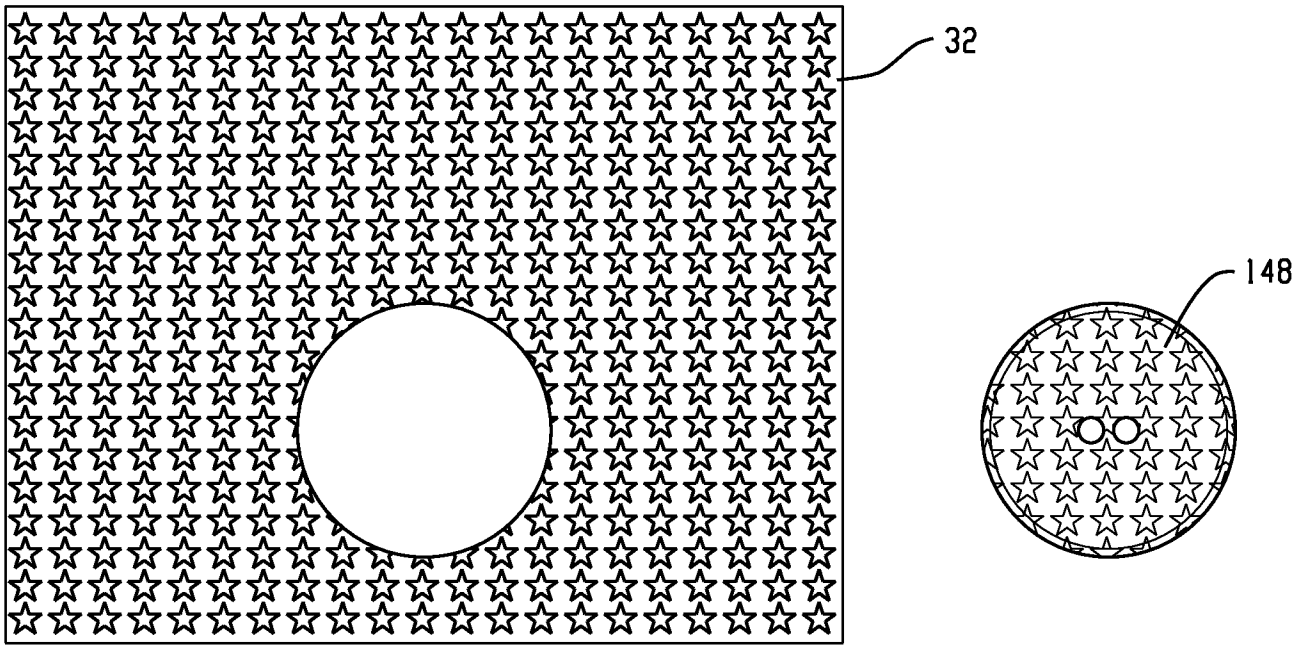
FIG. 10 is a plan view of the stock and the customized button.

With continued application of force to the lid press 104, the column blade 128 squeezes the button 40 and stock 32 together by contact with the stock face 118 of the alignment tool 110. Further still, the alignment pins 140 of the pressure column 138 extend toward the lid press 104 so as to pierce the stock 32 and be at least partially received within the alignment barrels 122 of the spacer 112. As shown in FIG. 9, the customized button 148 is then created. Subsequently, force is no longer directed through the lid press 104 and the lid press 104 is hinged open. Then, the customized button 148 may be removed from the studio tool 130. As shown in FIG. 10, the stock 32 now has a cutout that is complementary to the customized button 148. As the button 40 as illustrated is transparent, any designs that are present on the stock 32 are easily viewable when the customized button 148 is created.

Figure 12:
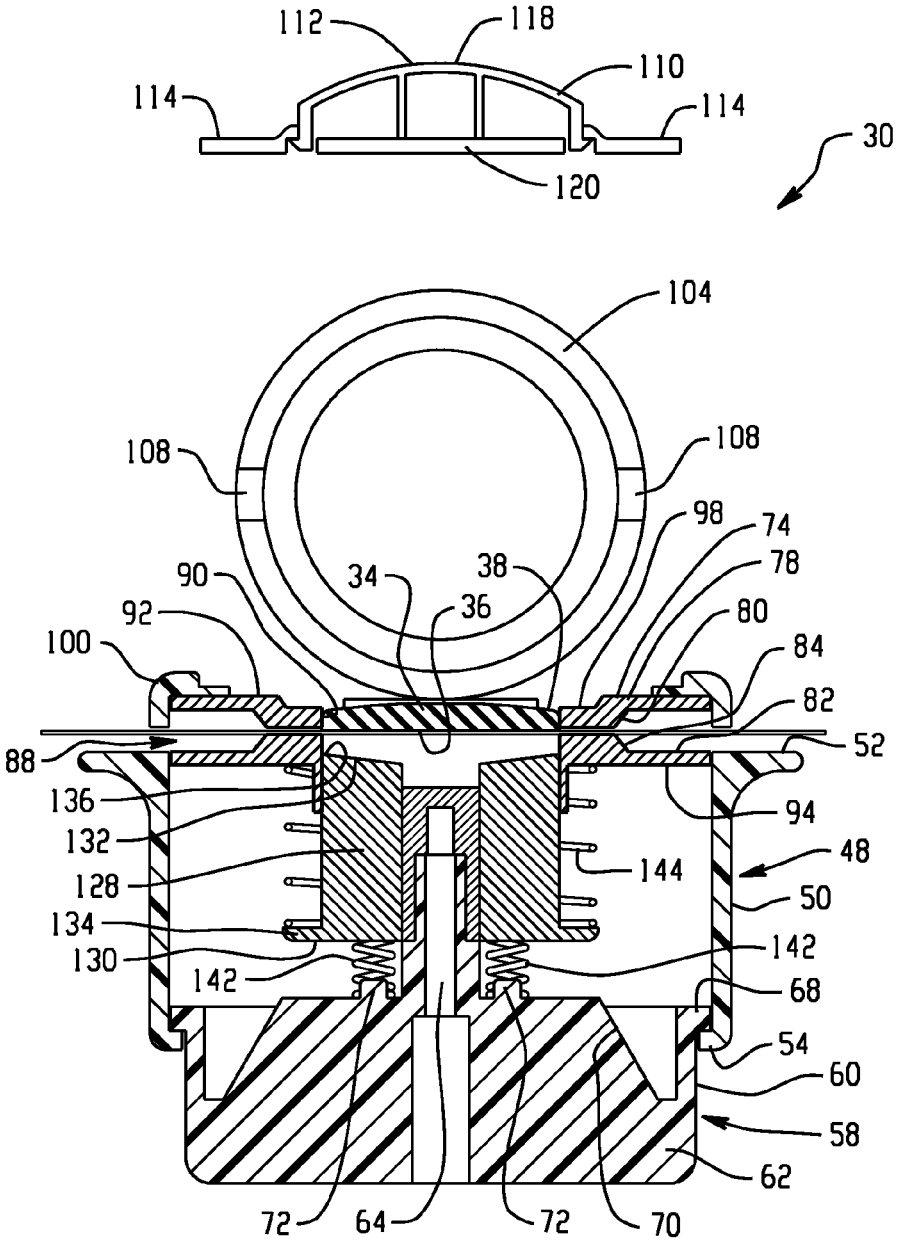
FIG. 12 is a sectional view of the studio tool with the stock and shape inserted into the studio tool.
Figure 14:
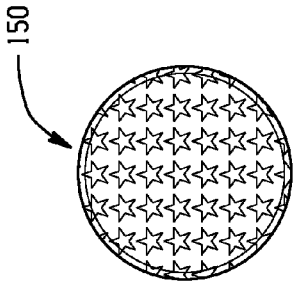
FIG. 14 is a plan view of the customized shape.
Figure 13:
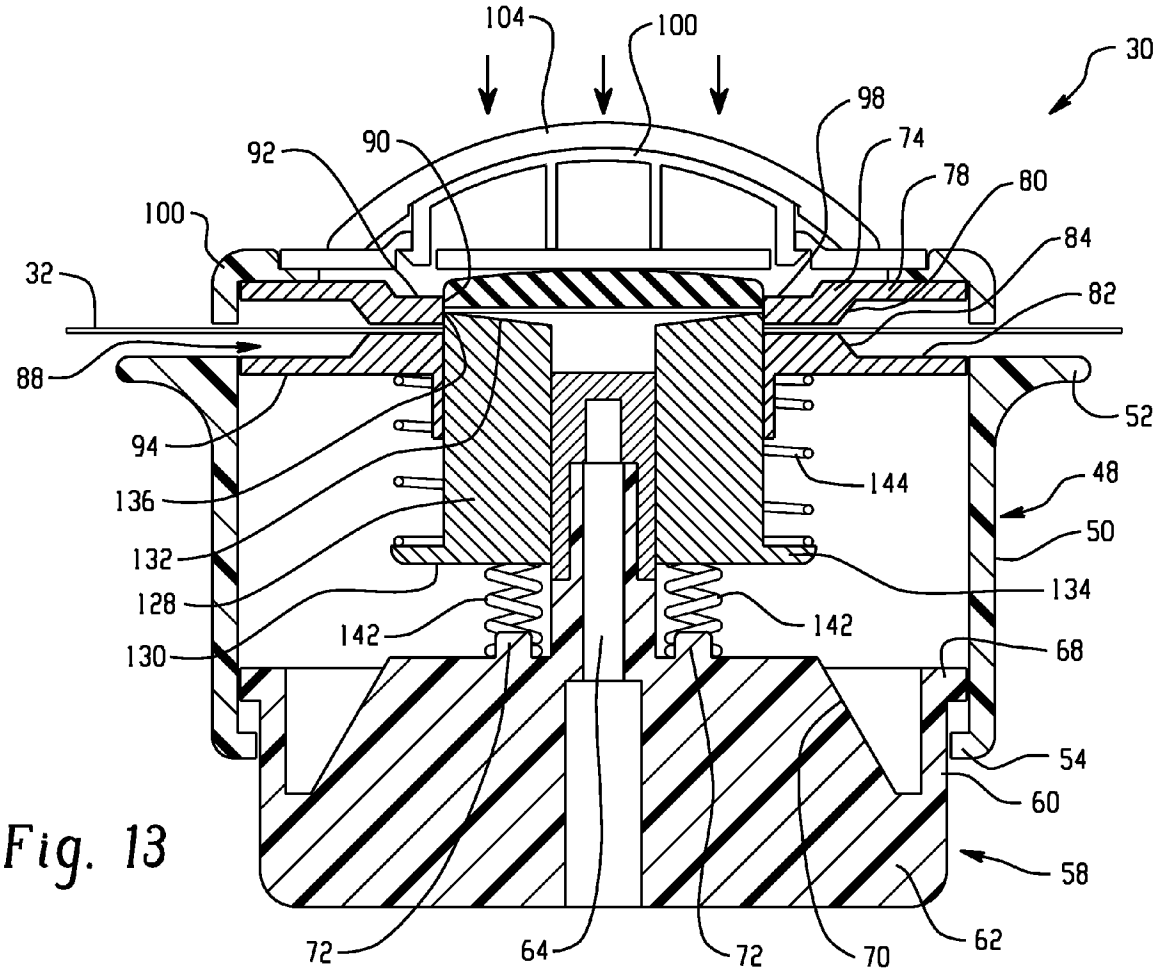
FIG. 13 is a sectional view of the studio tool cutting the stock.
Figure 15:
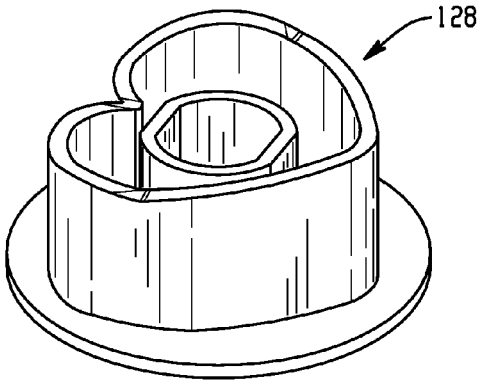
FIG. 15 is a perspective view of a heart-shaped column blade.
Figure 16:
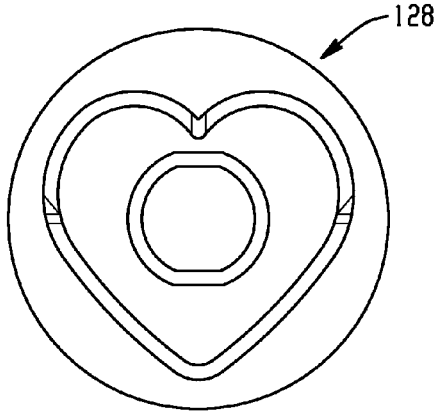
FIG. 16 is a plan view of FIG. 15.

FIG. 11 illustrates the studio tool 30 with the shape 34. As shown in FIG. 12, the shape 34 is inserted into the studio tool 30 such that the adhesive side 36 of the shape 34 faces toward the bottom wall 62 of the studio tool 30. Further, the stock 32 is inserted into the feed slot 88 of the studio tool 30. As shown in FIG. 13, a force is applied to the lid press 104 toward the bottom wall 62 of the lower housing 58. This causes the cutting edge 136 of the column blade 128 to extend through the aperture 90 so as to cut the stock 32 in a shape that is similar to the column blade 128. As additional force is applied to the lid press 104, the non-adhesive side 38 of the shape 34 contacts the stock face 118 of the spacer 112 to ensure good adhesion between the stock 32 and the shape 34. After the stock 32 and the shape 34 are joined together, the lip press 104 is hinged open. Then, the customized shape 150 may be removed from the studio tool 30. As shown in FIG. 14, the customized shape 150 may be transparent so that at least a portion of the stock 32 may be viewed through the shape 34.

It will be appreciated that the above-disclosed and other features and functions, or alternatives or varieties thereof, may be desirably combined into many other different systems or applications. Also, presently unforeseen or unanticipated alternatives, modifications, variations or improvements therein may be subsequently made by those in the art which are also intended to be encompassed by the following claims.

The invention claimed is:

1. A studio tool for working stock, comprising:

an upper housing including a sidewall that defines a generally circular cross-section;

a lower housing that slidably engages the upper housing, the lower housing including a side and a bottom wall, the side extending from the bottom wall toward the upper housing, wherein a column blade boss extends from the bottom wall in a direction generally parallel to the side;

a viewfinder at least partially fixed to the upper housing, the viewfinder including an upper guide and a lower guide that cooperate to define a feed slot, the viewfinder defining an aperture that extends through the upper and lower guides, a viewfinder cover at least partially circumferentially surrounding the upper guide of the viewfinder, the viewfinder cover including tab receipt areas;

a lid press hingedly attached to the viewfinder;

an alignment tool including a spacer with outwardly and radially extending tabs that are received by the tab receipt areas of the viewfinder cover, wherein the spacer includes a stock face and a lid press face, the stock face facing toward the stock and including alignment barrels extending toward the viewfinder, the lid press face facing toward the lid press;

a center piercer coaxially received on the column blade boss, the center piercer including alignment pins extending toward the lid press, wherein the alignment pins are selectively received by the alignment barrels of the alignment tool; and a column blade received within the upper housing and coaxially surrounding the center piercer, wherein the column blade selectively extends through the aperture to be coplanar with the upper guide.

2. The studio tool of claim 1, wherein the bottom wall of the lower housing further includes support flanges radially extending outward from the column blade boss toward the side.

3. The studio tool of claim 2, wherein the bottom wall of the lower housing further includes spring mounting pins extending toward the viewfinder and being radially disposed between the column blade boss and the respective support flange.

4. The studio tool of claim 3, wherein the column blade includes a lower face that faces toward the bottom wall and an upper face that faces toward the lid press.

5. The studio tool of claim 4, further comprising:

a plurality of lower springs mounted to the respective spring mounting pins, the lower springs exerting a biasing force on the lower face of the column blade.

6. The studio tool of claim 1, wherein the column blade further includes a spring ledge that radially extends outward, the spring ledge defining a diameter that is greater than a diameter of the aperture.

7. The studio tool of claim 6, further comprising:

a main spring coaxially surrounding at least a portion of the column blade, the main spring extending between the spring ledge of the column blade and the viewfinder.

8. The studio tool of claim 1, wherein the alignment tool further includes alignment springs that bias the barrels of the alignment tool away from the lid press face of the alignment tool.

9. The studio tool of claim 1, wherein the column blade has a circular cross-sectional shape.

10. The studio tool of claim 1, wherein the column blade has a five lobed flower cross-sectional shape.

11. The studio tool of claim 1, wherein the column blade is heart shaped.

12. A studio tool for working stock, comprising:

an upper housing including a sidewall extending between a feed ring and a retention ring, the feed ring extending radially outward from the sidewall and the retention ring extending radially inward from the sidewall, wherein the feed ring defines a top opening and the retention ring defines a bottom opening;

a lower housing at least partially received within the upper housing, the lower housing including a side extending between an annular lip and a bottom wall, the bottom wall including a column blade boss that extends toward the opening of the upper housing, the annular lip having a first outer diameter and the retention ring having a first inner diameter, wherein the first outer diameter is greater than the first inner diameter;

a viewfinder including a lower guide circumferentially surrounded by the feed ring of the upper housing and an upper guide located such that the lower guide is disposed between the upper guide of the viewfinder and the retention ring of the upper housing, the upper and lower guides cooperating to define a feed slot, the viewfinder defining an aperture that extends though the upper and lower guides in a direction generally parallel to the side of the lower housing, the upper and lower guides each including a feed ramp that circumferentially surrounds the aperture such that the feed ramps guide the stock between the upper and lower guides;

a viewfinder cover at least partially circumferentially surrounding the upper guide of the viewfinder, the viewfinder cover including tab receipt areas;

a lid press hingedly attached to the viewfinder;

an alignment tool including a spacer with outwardly and radially extending tabs that are received by the tab receipt areas of the viewfinder cover, wherein the spacer includes a stock face that faces toward the stock and a lid press face that faces toward the lid press; and a column blade coaxially received on the column blade boss and selectively movable between a first position and a second position, the first position defined by the column blade being coplanar with the lower guide such that the stock may be inserted into the feed slot and pass through the aperture, and the second position defined by the column blade being coplanar with the upper guide such that the stock is prevented from being inserted into the feed slot to pass through the aperture, wherein the column blade is closer to the lid press in the second position than in the first position.

13. The studio tool of claim 12, wherein the upper and lower housings are generally circular in cross-section and slidingly engage one another.

14. The studio tool of claim 12, wherein the lid press also includes tab receipt areas.

15. The studio tool of claim 14, wherein the tab receipt areas of the lid press and the tab receipt areas of the viewfinder cover cooperate to surround the tabs of the alignment tool when the lid press is closed.

16. The studio tool of claim 12, further comprising:

a main spring coaxially surrounding at least a portion of the column blade.

17. The studio tool of claim 16, wherein the viewfinder includes a spacer face and a main spring face, the spacer face facing toward the spacer of the alignment tool and the main spring face contacting the main spring.

18. The studio tool of claim 17, wherein the spacer face of the viewfinder defines an annular depression that surrounds the aperture.

19. The studio tool of claim 12, wherein the lid press and the alignment tool are transparent such that column blade is visible when the lid press is closed.

20. The studio tool of claim 12, wherein the viewfinder cover is C-shaped to allow for connection between the lid press and the viewfinder.

* * * * *